US005794699A

United States Patent [19]

Hammett et al.

[11] Patent Number: 5,794,699

[45] Date of Patent: Aug. 18, 1998

[54] METAL-TO-METAL SLIDING SIDE DOOR FOR WELLS

[75] Inventors: Robert C. Hammett, Garland; Bhanubhai H. Patel, Grand Prairie; William R. Welch, Carrollton; Ronald K. Churchman, Dallas, all of Tex.

[73] Assignee: Halliburton Energy Services, Inc., Dallas, Tex.

[21] Appl. No.: 753,662

[22] Filed: Nov. 27, 1996

[51] Int. Cl.[6] ..... E21B 33/00

[52] U.S. Cl. ..... 166/332.2

[58] Field of Search ..... 166/332.3, 330, 166/100, 169

[56] References Cited

U.S. PATENT DOCUMENTS

| | | | |
|---|---|---|---|
| 3,376,936 | 4/1968 | Tomlin | 166/334.4 |
| 3,815,675 | 6/1974 | Peters | 166/332.3 |
| 4,296,807 | 10/1981 | Hendrickson et al. | 166/334.4 |
| 4,433,862 | 2/1984 | Raulins et al. | 285/350 |
| 4,458,925 | 7/1984 | Raulins et al. | 285/332.2 |
| 4,473,245 | 9/1984 | Raulins et al. | 285/334 |
| 4,489,963 | 12/1984 | Raulins et al. | 285/350 |

*Primary Examiner*—William P. Neuder
*Attorney, Agent, or Firm*—William M. Imwalle; Paul I. Herman; John F. Booth

[57] ABSTRACT

Assemblies and methods are provided for selectively opening and closing a side port in a flow conductor for a well. In general, the sliding side door assembly includes a housing and a door subassembly. The housing has a generally tubular shape defining a fluid conducting interior and central axis. A side port is formed in the housing, and a ball seat is positioned in the housing adjacent the side port. The door subassembly is operatively engaged with the housing adjacent the side port and includes a translating sleeve positioned within the housing and a ball sealing member adapted to engage the ball seat of the housing. A ball port is formed through the ball sealing member. A cooperatively engaged helical track and follower member are provided for translating a driving movement along the central axis through the translating sleeve to a rotational movement of the ball sealing member about the central axis. Driving movements acting on the door subassembly can be provided by a standard shifting tool. Thus, a first driving movement acting on the door subassembly in a first axial direction along the central axis causes the translating sleeve to rotate the ball sealing member such that the ball port moves into overlapping alignment with the side port, thereby opening the side port. Similarly, a second driving movement acting on the door subassembly in a second axial direction along the central axis causes the translating sleeve to rotate the ball sealing member such that the ball port moves out of overlapping alignment with the side port, thereby closing the side port.

24 Claims, 3 Drawing Sheets

METAL-TO-METAL SLIDING SIDE DOOR FOR WELLS

TECHNICAL FIELD

This invention relates to well tools and more particularly to flow control devices. According to the invention, new assemblies and methods are provided for opening and closing a side door in a fluid conductor for wells, such as a tubing string for use in oil and gas wells.

BACKGROUND OF THE INVENTION

Conventional side doors for use in oil and gas wells include elastomeric seals for sealing the side port of the fluid conductor. In some cases, however, the side door assembly is needed in down-hole environments subjecting the side door assembly to hostile conditions, such as high temperature, abrasion, and corrosive chemicals. The elastomeric seals have a relatively short useful life under such hostile conditions.

For example, U.S. Pat. No. 3,051,243 issued to George G. Grimmer and James H. Bostock on Aug. 28, 1962 describes flow control devices connectable in a well flow conductor and to well tools for operating the flow control devices while they are connected in the well flow conductor. These flow control devices include a nipple provided with lateral ports and a valve sleeve longitudinally slidably positioned in the nipple for movement between an open position wherein the ports of the nipple are fully opened to permit flow of fluids into the conductor, an equalizing position wherein the flow of well fluids through the ports is restricted whereby the pressure differential between the exterior of the flow conductor and the interior of the flow conductor may be equalized slowly, and a closed position wherein the lateral ports of the nipple are closed to prevent any flow of fluids therethrough into the well flow conductor. However, elastomeric sealing assemblies and an O-ring are positioned and adapted to seal between a sealing sleeve section of the nipple and the valve sleeve which is longitudinally movable in the nipple. These elastomeric elements are susceptible to degradation under harsh environmental conditions. U.S. Pat. No. 3,051,243 is incorporated herein by reference in its entirety.

U.S. Pat. No. 3,414,060 issued to Joseph T. Zak on Dec. 3, 1968 describes a selective shifting tool for use in well tubing in conjunction with shifting a sleeve and establishing communication in drilling and production operations between the tubing-casing annulus. The shifting tool can be a mandrel, a wire line attachment at the upper end of the mandrel for connection with a wire line and lowering the tool into a shiftable sleeve to engage and lift the sleeve to move the ports thereof into alignment with the ports in the tubing, thus establishing communication with the tubing-casing annulus, or in the event of multiple completion, establishing connection with another zone where pressure of the other zone is greater than the tubing pressure. U.S. Pat. No. 3,414,060 is incorporated herein by reference in its entirety.

Improvements in the apparatuses and methods for opening and closing a side port in a well are needed, especially when needed to be deployed in hostile down-hole well environments. Thus, there has been a long-felt need for assemblies and methods that are more resistant to hostile environmental conditions such as high temperature, abrasion, and corrosive chemicals.

SUMMARY OF THE INVENTION

According to the invention, improved assemblies and methods are provided for selectively opening and closing a side port in a flow conductor for a well. More particularly, a sliding side door assembly and method of using the sliding side door assembly is provided for use in a well bore.

In general, the sliding side door assembly includes a housing and a door subassembly.

The housing has a generally tubular shape defining a fluid conducting interior therethrough and central axis. A side port is formed in the housing, and a ball seat is positioned in the housing adjacent the side port.

The door subassembly is operatively engaged with the housing adjacent the side port. The door subassembly includes a translating sleeve positioned within the housing and adjacent the side port and a ball sealing member defining a generally spherical sealing surface adapted to engage the ball seat of the housing. A ball port is formed through the ball sealing member. The purpose of the translating sleeve is to provide a structure for translating a driving axial movement of a standard shifting or positioning tool to a rotational movement of the ball sealing member, whereby the rotational movement rotates the ball port into and out of overlapping alignment with the side port to open and close the side port. According to the invention, a cooperatively engaged helical track and follower member are provided for translating a driving movement along the central axis through the translating sleeve to a rotational movement of the ball sealing member about the central axis.

Driving movements acting on the door subassembly can be provided by a standard shifting tool. Thus, a driving movement acting on the door subassembly in an axial direction along the central axis causes the translating sleeve to rotate the ball sealing member, thereby opening or closing the side port.

Thus, according to the invention, a sliding side door assembly is provided that has metal-to-metal sealing surfaces. This metal-to-metal engagement eliminates the need for elastomeric seals. The metal-to-metal sliding side door is capable of withstanding more extreme environmental conditions than a side door having elastomeric seal. These and other aspects, features, and advantages of the present invention will be apparent to those skilled in the art upon reading the following detailed description of preferred embodiments according to the invention.

BRIEF DESCRIPTION OF THE DRAWINGS

The accompanying drawings are incorporated into and form a part of the specification to provide illustrative examples of the present invention. These drawings with the description serve to explain the principles of the invention. The drawings are only for purposes of illustrating preferred and alternate embodiments of how the invention can be made and used. The drawings are not to be construed as limiting the invention to only the illustrated and described examples. Various advantages and features of the present invention will be apparent from a consideration of the accompanying drawings in which.

DETAILED DESCRIPTION OF PREFERRED EMBODIMENTS

Figure 1:
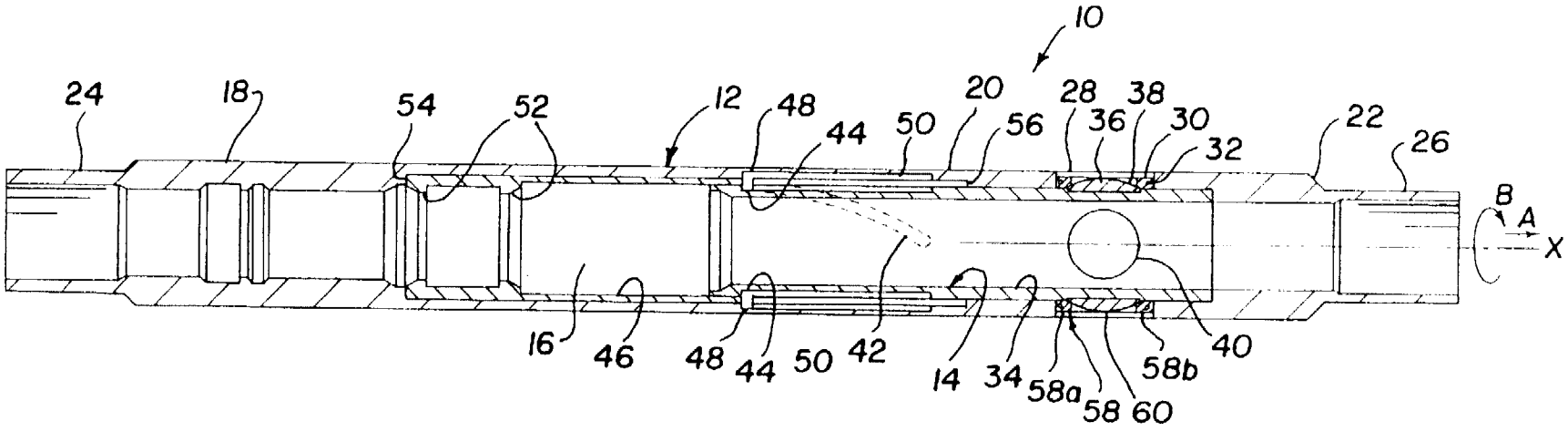
FIG. 1 is a cross-sectional view taken along the central axis of a sliding side door assembly according to a first embodiment of the invention in which the door subassembly is shown in the closed position.

The present invention will be described by referring to drawings of examples of how the invention can be made and used. Like reference characters are used throughout the several figures of the drawings to indicate like or corresponding parts.

First Embodiment

Referring first to FIG. I of the drawings, a first embodiment of a metal-to-metal sliding side door assembly according to the invention is illustrated. The sliding side door assembly according to this first embodiment is generally referred to by the reference numeral 10. The sliding side door assembly 10 is particularly adapted for use in a well bore and in general includes a housing 12 and a door subassembly 14.

The housing 12 has a generally tubular shape defining an interior flow conductor 16 therethrough and a central axis X. The housing 12 can be formed in one or more parts as may be appropriate taking into account manufacturing and assembly considerations. The housing 12 preferably has an upper subsection 18, an intermediate subsection 20, and a lower subsection 22. In the following description, the terms "upper", "upward", "lower", "below", "down hole", and the like, as used herein, shall mean in relation to the bottom, or furthest extent of, the surrounding wellbore even though the wellbore or portions of it may be deviated or horizontal. The upper subsection 18 preferably has a reduced externally threaded upper end portion 24 so that it can be connected to an end of a well flow conductor, such as a tubing string section (not shown) by means, for example, of a suitable tubular coupling collar (not shown) according to methods well known in the art. The lower subsection 22 is preferably similarly provided with a lower reduced externally threaded end portion 26 so that it too can be connected to another end of a well flow conductor, such as a tubing string section (not shown) by means, for example, of a suitable tubular coupling collar (not shown). According to an alternative embodiment, the upper subsection 18 of the housing 12 can be integrally formed with a tubing section (not shown) for use in a tubing string.

The upper subsection 18 preferably has reduced internal bores adjacent its end portion 24 to provide key retaining surfaces and camming shoulders for engaging a standard shifting or positioning tool to thereby allow engaging the sliding side door assembly 10. Such shifting or positioned tools are well known in the art and commercially available, for example, from Halliburton Energy Services.

The housing 12 has a side port 28 formed therein for providing fluid communication between the interior 16 of the housing 12 and the exterior of the housing, such as to an annular area around the housing 12 or with a side bore of the well. A ball seat 30 is positioned in the housing 12 adjacent the side port 28. As will hereinafter be described in detail, the ball seat 30 is adapted to receive and engage a portion of a generally spherical sealing surface defined by a ball sealing member. According to the invention, the ball seat 30 is formed of metal. The metal is selected to withstand hostile down-hole well conditions. An O-ring 32 is preferably included to help the ball seat 30 seal the side port 28. According to the invention, the O-ring 32 is also most preferably formed of metal.

As used herein, the term "generally spherical sealing surface" is intended to define a surface having a contour of at least a portion of a sphere. It is to be understood that the sealing surface is not required to be completely spherical, but only that the sealing surface can be rotated between at least two positions and such that the spherical surface contour is presented to engage a seat, such as ball seat 30, as the sealing surface is rotated between the two positions. For example, the term "generally spherical sealing surface" can include a dome shaped surface mounted for movement within the housing 12 adjacent the side port 28.

The door subassembly 14 is operatively engaged with the housing 12 adjacent the side port 28. The door subassembly 14 is for selectively opening and closing the side port 28. The door subassembly 14 according to the first embodiment of the invention is shown in FIG. 1.

According to the first embodiment of the invention, the door subassembly 14 includes a translating sleeve 34 positioned within the housing 12 and adjacent the side port 28. The translating sleeve 34 is preferably in the form of a hollow tubular member.

The door subassembly 14 according to the first embodiment of the invention includes a ball sealing member 36 defining a spherical sealing surface 38 that is adapted to engage with the ball seat 30. The ball sealing member 36 includes ball port 40, which is illustrated in phantom lines. In the first embodiment according to the invention, the ball port 40 is preferably of the same size and shape as the side port 28. It is to be understood that by rotating the ball sealing member 36 about the central axis X of the housing 12, the ball port 40 can be moved into overlapping alignment with the side port 28 of the housing 12 to open the side port.

As previously mentioned, the ball seat 30 and O-ring 32 are both most preferably formed of metal, and the ball sealing member 36 is also formed of metal, thereby creating a metal-to-metal seal between the ball seat 30 and the ball sealing member 36 without need for any elastomeric seals.

According to the first embodiment of the invention, the ball sealing member 36 is preferably positioned on the translating sleeve to move with the translating sleeve 34. For example, the ball sealing member 36 can be integrally formed on the translating sleeve 34. However, because of manufacturing and assembly challenges presented by such an integral construction, the ball sealing member 36 can alternatively be formed in two or more ball segments, which when assembled onto the translating sleeve 34 can be forced to rotate with the translating sleeve 34 by suitable structures, such as splines or pins engaging corresponding receiving structures in the segments of the ball sealing member 36. Forming the ball sealing member 36 in segments, analogous to cored apple slices, for example, may be desirable for manufacturing and assembly considerations, whereby the segments can be positioned within the housing 12 whereas an integrally formed ball sealing member would be more difficult to engineer for positioning within the housing 12.

Furthermore, the door subassembly 14 according to the first embodiment of the invention includes cooperatively engaged helical tracks 42 and follower members 44 for translating a driving movement along the central axis X through the translating sleeve 34 to a rotational movement of the ball sealing member 36 formed or mounted on the translating sleeve 34 to move therewith about the central axis X. The helical tracks 42 are preferably in the form of a pair of helically symmetrical and balanced tracks, although only one of the tracks is represented in FIG. 1 for clarity of the drawings. The two diametrically opposed follower members 44 are employed to engage the pair of helical tracks 42. It is to be understood, however, the additional helical tracks and follower members can be used as a matter of engineering design to translate an axial movement to a rotational movement. In the illustrated first embodiment, the follower members 44 are in the form of pins as shown in FIG. 1 of the drawings.

In the first embodiment according to the invention, the door subassembly 14 includes a shifting sleeve 46 positioned for movement along the central axis X within the housing 12 adjacent the translating sleeve 34. Alignment members 48 and alignment grooves 50 are cooperatively positioned and engaged between the shifting sleeve 46 and the housing 12 such that the shifting sleeve 46 can move along the central axis X but is prevented from rotational movement about the central axis X. In the illustrated embodiment of FIG. 1, each of the alignment members 48 is in the form of a pin; it is to be understood, however, that the alignment member 48 can have any other suitable structural form, such as a spline. In the first embodiment of the invention, the alignment members 48 are formed on the shifting sleeve 46 and the alignment grooves 50 are formed on the interior wall of the housing 12, however, such relative positioning of the alignment members 48 and grooves 50 is a matter of engineering design choice. Furthermore, only one cooperatively engaged alignment member 48 and alignment groove 50 is required; however, at least two are preferred, and most preferably the illustrated diametrically opposed pair of such engaging features.

In the first embodiment according to the invention, the helical tracks 42 are shown positioned in the exterior surface of the translating sleeve, and the track followers 44 are shown positioned on the interior surface of the shifting sleeve 46. It is to be understood that such relative positioning of the helical tracks and followers is a matter of engineering design choice; for example, it is envisioned that the helical tracks can be alternatively formed on the interior surface of the shifting sleeve and the track followers can be formed on the translating sleeve.

According to the first embodiment of the invention illustrated in FIG. 1, the shifting sleeve 46 has a plurality of key retaining and camming structures 52, whereby a standard positioning tool (not shown) can be used to engage with the shifting sleeve 46 and move the shifting sleeve along the central axis X. The longitudinal movement of the shifting sleeve 46 along the axis X is stopped by upper shoulder 54 and lower shoulder 56, thereby defining the range of movement for the shifting sleeve 46.

The sliding side door assembly 10 preferably includes a seat cushion 58 for the ball sealing member 36. In the first embodiment of the invention, the seat cushion 58 is preferably positioned substantially circumferential of the housing, having a first portion 58*a* above the ball sealing member 36 and a second portion 58*b* below the ball sealing member 36, the first and second portions 58*a* and 58*b* of the seat cushion being adapted to engage and retain the ball sealing member 36 in position within the housing 12. The ends of the first and second portions 58*a* and 58*b* forming the seat cushion in the first embodiment according to the invention are preferably formed to abut the ball seat 30. Thus, the translating sleeve 34, on which the sealing ball member 36 is rigidly mounted according to the first embodiment of the invention, is also maintained in position within the housing, being prevented from movement along the central axis X of the housing 12.

Furthermore, the door subassembly 14 of the sliding side door assembly 10 preferably includes a spring 60, most preferably of the Belville type, positioned in the housing 12 opposite the side port 28 to urge the ball sealing member 36 toward the side port 28. The spring 60 assists in maintaining a sealing engagement between the surface 38 of the ball sealing member 36 and the ball seat 30 of the housing 12.

Thus, according to the first embodiment of the invention, a first driving movement acting on the shifting sleeve 46 of the door subassembly 14 in a first axial direction represented by the arrow A along the central axis X causes the translating sleeve 34 to rotate the ball sealing member 36 about the central axis X in the rotational direction indicated by the arrow B such that the ball port 40 moves into overlapping alignment with the side port 28, thereby opening the side port. According to the first embodiment, a second driving movement acting on the shifting sleeve 46 of the door subassembly 14 in a second axial direction along the central axis X opposite the first axial direction A causes the translating sleeve 34 to rotate the ball sealing member 36 in a rotational direction opposite to that indicated by the arrow B such that the ball port 40 moves out of overlapping alignment with the side port 28 and back to the position shown in FIG. 1, thereby closing the side port.

Second Embodiment

Referring now to FIGS. 2–5 of the drawings, a second, more preferred embodiment of a metal-to-metal sliding side door assembly according to the invention is illustrated. The sliding side door assembly according to the second embodiment is generally referred to by the reference numeral 100. The sliding side door assembly 100 is particularly adapted for use in a well bore and in general includes a housing 112 and a door subassembly 114.

The housing 112 has a generally tubular shape defining an interior flow conductor 116 and a central axis X. The housing 112 can be formed in one or more parts as may be appropriate taking into account manufacturing and assembly considerations. The housing 112 preferably has an upper subsection 118, an intermediate subsection 120, and a lower subsection 122. The upper subsection 118 preferably has a reduced externally threaded upper end portion 124 so that it can be connected to an end of a well flow conductor, such as a tubing string section (not shown) by means, for example, of a suitable tubular coupling collar (not shown) according to methods well known in the art. The lower subsection 122 is preferably similarly provided with a lower reduced externally threaded end portion 126 so that it too can be connected to another end of a well flow conductor, such as a tubing string section (not shown) by means, for example, of a suitable tubular coupling collar (not shown). To facilitate assembly of the sliding side door assembly 100 according to the second embodiment of the invention, the upper subsection 118 is preferably connected to the intermediate subsection 120 at threaded interface 127. According to an alternative embodiment, the upper subsection 118 of the housing 112 can be integrally formed with a tubing section (not shown) for use in a tubing string.

The upper subsection 118 preferably has reduced internal bores adjacent its end portion 124 to provide key retaining surfaces and camming shoulders for engaging a standard shifting or positioning tool for engaging the door sliding side door assembly 100. Such shifting or positioned tools are well known in the art and commercially available, for example, from Halliburton Energy Services.

The housing 112 has a side port 128 formed therein for providing fluid communication between the interior 116 of the housing 112 and the exterior of the housing, such as to an annular area around the housing 112 or with a side bore of the well. A ball seat 130 is positioned in the housing 112 adjacent the side port 128. As will hereinafter be described in detail, the ball seat 130 is adapted to receive and engage a portion of a generally spherical sealing surface defined by a ball sealing member. According to the invention, the ball seat 130 is formed of metal. The metal is selected to withstand hostile down-hole well conditions. An O-ring 132 is preferably included to help the ball seat 130 seal the side port 128. According to the invention, the O-ring 132 is also most preferably formed of metal.

The door subassembly 114 is operatively engaged with the housing 112 adjacent the side port 128. The door subassembly 114 according to the second embodiment of the invention is for selectively opening and closing the side port 128. The door subassembly 114 according to the second embodiment of the invention is shown in FIGS. 2–5.

The door subassembly 114 includes a translating sleeve 134 positioned within the housing 112 and adjacent the side port 128. The translating sleeve 134 is preferably in the form of a hollow tubular member.

According to the second embodiment of the invention, the door subassembly 114 preferably includes a sleeve port 135 formed in the translating sleeve 134. The sleeve port 135 is preferably the same size and shape as the side port 128. It is to be understood that according to the second embodiment of the invention, shifting the translating sleeve 134 along the central axis X of the housing from the position shown in FIG. 2 to the position shown in FIG. 4 of the drawings will cause the sleeve port 135 to be moved into overlapping alignment with the side port 128 of the housing 112.

The door subassembly 114 according to the second embodiment of the invention includes a ball sealing member 136 defining a generally spherical sealing surface 138 that is adapted to engage with the ball seat 130.

Figure 3:
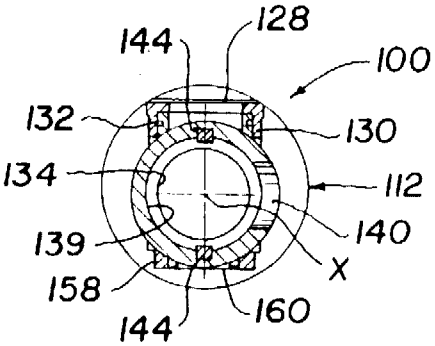
FIG. 3 is a cross-sectional view taken perpendicular to the central axis along line 3—3 of FIG. 2.
Figure 4:
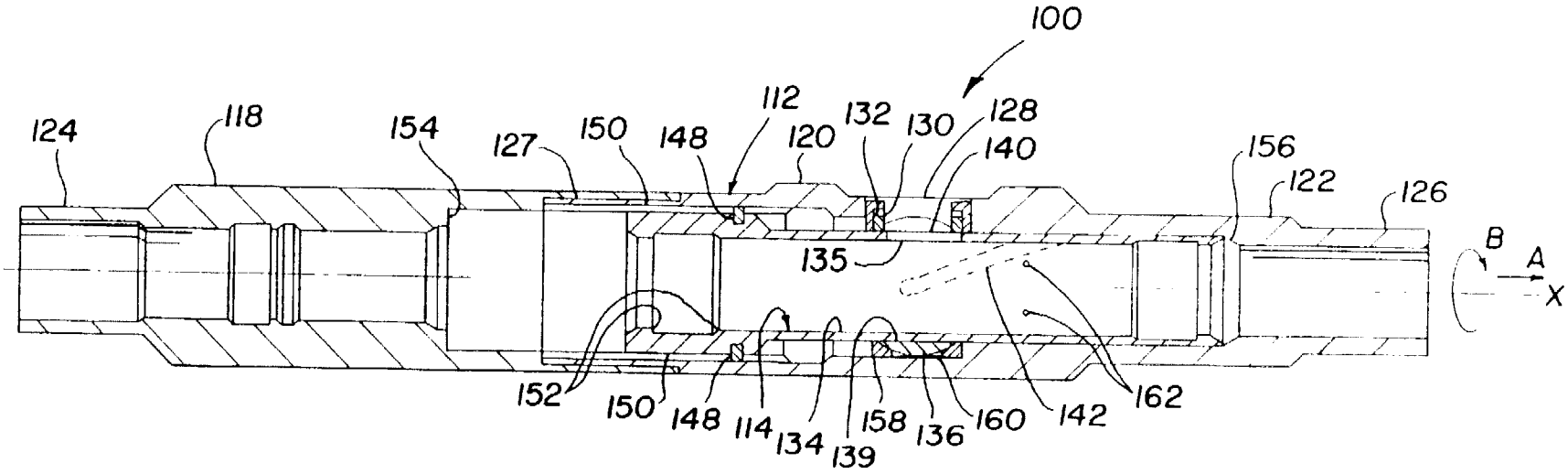
FIG. 4 is a cross-sectional view taken along the central axis of the sliding side door assembly according to the second embodiment of the invention in which the door subassembly is shown moved into the open position.
Figure 5:
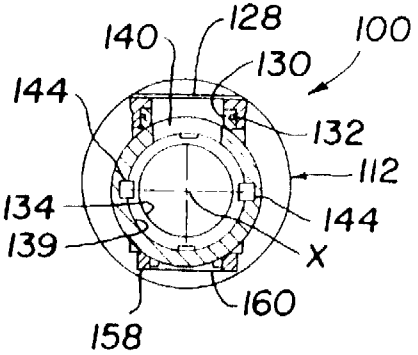
FIG. 5 is a cross-sectional view taken perpendicular to the central axis along line 5—5 of FIG. 4 to illustrate the overlapping alignment of the ball port and the sleeve port with the side port to open the side port.

As best shown in FIG. 3, the ball sealing member 136 has a ball bore 139 formed through the ball sealing member 136. A portion of the translating sleeve 134 of the door subassembly 114 is positioned in the ball bore 139 of the ball sealing member 136. Thus, according to the second embodiment of the invention, the ball sealing member 136 can be rotated relative to the translating sleeve 134.

Figure 2:
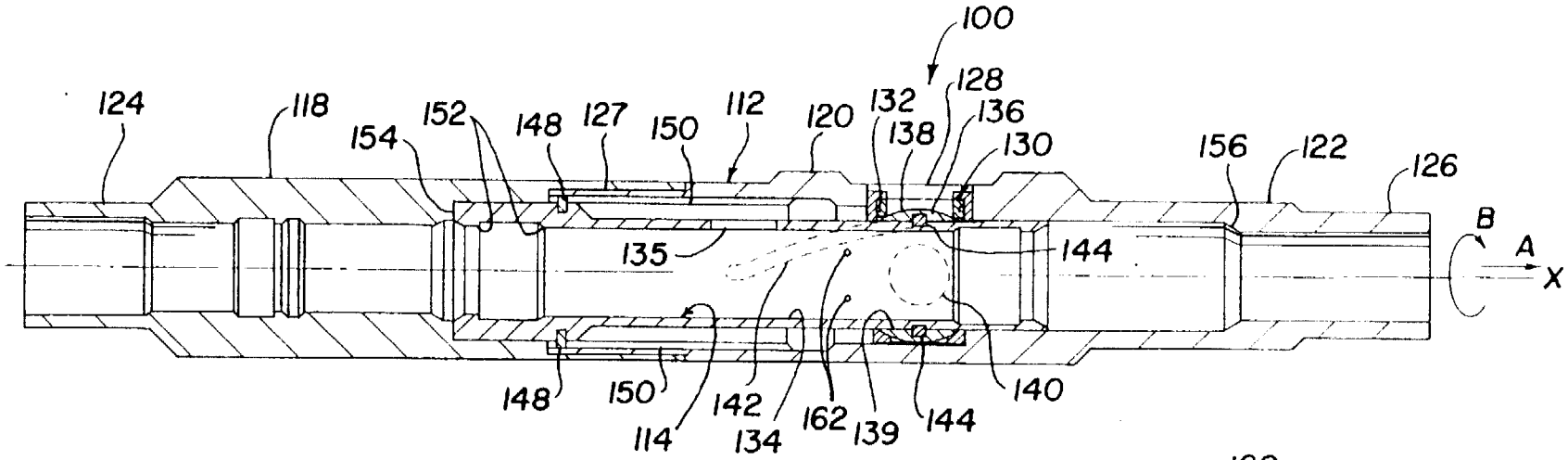
FIG. 2 is a cross-sectional view taken along the central axis of a sliding side door assembly according to a second, more preferred embodiment of the invention in which the door subassembly is shown in the closed position.

The ball sealing member 136 includes ball port 140, which is illustrated in phantom lines in FIG. 2 of the drawings. In the second embodiment according to the invention, the ball port 140 is preferably of the same size and shape as the side port 128. It is to be understood that by rotating the ball sealing member 136 about the central axis X of the housing 112, the ball port 140 can be moved into overlapping alignment with the side port 128 of the housing 112 to open the side port.

As previously mentioned, the ball seat 130 and O-ring 132 are both most preferably formed of metal, and the ball sealing member 136 is also formed of metal, thereby creating a metal-to-metal seal between the ball seat 130 and the ball sealing member 136 without need for any elastomeric seals.

Furthermore, the door subassembly 114 according to the second embodiment of the invention includes cooperatively engaged helical tracks 142 and follower members 144 for translating a driving movement along the central axis X through the translating sleeve 134 to a rotational movement of the ball sealing member 136 about the central axis X. The helical tracks 142 are preferably in the form of a pair of helically symmetrical and balanced tracks, although only one of the tracks is represented in the FIGS. 2 and 4 for clarity of the drawings. Two diametrically opposed follower members 144 are employed for the pair of helical tracks 142. In the second embodiment according to the invention, the helical tracks 142 are shown positioned in the exterior surface of the translating sleeve 134, and the track followers 144 are shown positioned on the interior surface of the ball bore 139 of the ball sealing member 136. It is to be understood, however, the additional helical tracks and follower members can be used as a matter of engineering design to translate an axial movement to a rotational movement. In the illustrated second embodiment, the follower members 144 are in the form of pins as shown in the drawings.

In the second embodiment according to the invention, the door subassembly 114 does not require a separate shifting sleeve.

Alignment members 148 and alignment grooves 150 are cooperatively positioned and engaged between the translating sleeve 134 and the housing 112 such that the translating sleeve 134 can move along the central axis X but is prevented from rotational movement about the central axis X. In the illustrated embodiment of FIG. 2, each of the alignment members 148 is in the form of a pin; it is to be understood, however, that the alignment member 148 can have any other suitable structural form, such as a spline. In the second embodiment of the invention, the alignment members 148 are formed on the translating sleeve 134 and the alignment grooves 150 are formed on the interior wall of the housing 112; however, such relative positioning of the alignment members 148 and grooves 150 is a matter of engineering design choice. Furthermore, only one cooperatively engaged alignment member 148 and alignment groove 150 is required; however, at least two are preferred, and the illustrated diametrically opposed pair of such engaging features is most preferred.

According to the second embodiment of the invention illustrated in FIG. 2, the translating sleeve 134 has a plurality of key retaining and camming structures 152, whereby a standard positioning tool (not shown) can be used to engage with the translating sleeve 134 and move the translating sleeve along the central axis X. The longitudinal movement of the translating sleeve 134 along the axis X is stopped by upper shoulder 154 and lower shoulder 156, thereby defining the range of movement for the translating sleeve 134.

The sliding side door assembly 100 preferably includes a seat cushion 158 for the ball sealing member 136. In the second embodiment of the invention, the seat cushion 158 is preferably positioned opposite the side port 128 of the housing 112.

Furthermore, the door subassembly 114 of the sliding side door assembly 100 preferably includes a spring 160, most preferably of the Belville type, positioned in the housing 112 opposite the side port 128 to urge the ball sealing member 136 toward the side port 128. The spring 160 assists in maintaining a sealing engagement between the generally spherical sealing surface 138 of the ball sealing member 136 on the translating sleeve 134 and the ball seat 130 of the housing 112. Having the ball seat 130 and seat cushion 158 constantly spring loaded against the ball sealing member 136 assures that debris will not intrude between the sealing surfaces. Additionally the sealing surfaces are wiped clean during each rotational cycle of the ball sealing member 136.

Thus, a first driving movement acting on the translating sleeve 134 of the door subassembly 114 in a first axial direction indicated by the arrow A along the central axis X causes the translating sleeve 134 to move in the first axial direction, which causes the follower members 144 on the ball sealing member 136 engaged with the helical tracks 142 on the translating sleeve 134 to rotate the ball sealing member 136 in a first rotational direction indicated by the arrow B about the central axis X, thereby causing the sleeve port 139 to move into overlapping alignment with the side port 128 and causing the ball port 140 to move into overlapping alignment with the side port 128, thereby opening the side port.

A second driving movement acting on the translating sleeve 134 of the door subassembly 114 in a second axial direction opposite the direction indicated by the arrow A along the central axis X causes the translating sleeve 134 to move in the second axial direction, which causes the follower members 144 on the ball sealing member 136 engaged with the helical tracks 142 on the translating sleeve 134 to rotate the ball sealing member 136 in a second rotational direction opposite to the rotational direction indicated by the arrow B about the central axis, thereby causing the sleeve port 139 to move out of overlapping alignment with the side port 128 and causing the ball port 140 to move out of overlapping alignment with the side port 128, thereby closing the side port.

The sliding side door assembly 100 can be dimensioned or ported to be self-equalizing by the choking effect of the tight tolerance between the internal diameter of the housing 112 and the translating sleeve 134. The action would be such that partial rotation of the ball sealing member 136 would occur prior to the sleeve port 135 of the translating sleeve 134 passing the leading edge of the side port 128.

Additionally, in the second embodiment, at least one equalizing port 162 is preferably provided in the translating sleeve 134. More preferably, several equalizing ports 162 are provided, which are spaced circumferentially around the translating sleeve 134 intermediate the length of the helical tracks 142. Thus, at least one of the equalizing ports 162 moves into overlapping alignment with the side port as the translating sleeve 134 is moved from the position shown in FIG. 2 to the position shown in FIG. 4 of the drawings. The equalizing port 162 is preferably substantially smaller than the side port 128 and the ball seat 130, whereby at least some of any differential pressure across the side port 128 when it is closed can be choked and equalized through the equalizing port 162 before the sleeve port 135 and ball port 140 are moved into overlapping alignment to open the side port 128, thereby helping to reduce the effects of flow-cutting across the closure mechanism.

The embodiments shown and described above are only exemplary. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of parts within the principles of the invention to the full extent indicated by the broad and general meaning of the terms used in the attached claims.

The restrictive description and drawings of the specific examples above do not point out what an infringement of this patent would be, but are to provide at least one explanation of how to make and use the inventions. The limit of the inventions and the bounds of the patent protection are measured by and defined in the following claims.

Having described the invention, what is claimed is:

1. A sliding side door assembly for use in a well bore having a side bore, the sliding side door assembly comprising:

(a) a housing having a generally tubular shape defining a central axis;

(b) a side port formed in the housing;

(c) a ball seat positioned in the housing adjacent the side port;

(d) a door subassembly operatively engaged with the housing adjacent the side port, the door subassembly further comprising:

(i) a translating sleeve positioned within the housing and adjacent the side port;

(ii) a ball sealing member defining a generally spherical sealing surface that is adapted to engage the ball seat;

(iii) a ball port formed through the ball sealing member; and (iv) a cooperatively engaged helical track and follower member for translating a driving movement along the central axis through the translating sleeve to a rotational movement of the ball sealing member about the central axis;

whereby a driving movement acting on the door subassembly in an axial direction along the central axis causes the translating sleeve to rotate the ball sealing member, thereby opening or closing the side port.

2. The sliding side door assembly according to claim 1, wherein the ball sealing member is positioned on the translating sleeve to move with the translating sleeve.

3. The sliding side door assembly according to claim 2, wherein the ball sealing member is formed in at least two segments.

4. The sliding side door assembly according to claim 2, further comprising a spring positioned in the housing opposite the side port to urge the ball sealing member toward the side port, thereby assisting in maintaining a sealing engagement between the ball sealing member on the translating sleeve and the ball seat.

5. The sliding side door assembly according to claim 4, further comprising a seat cushion for the translating sleeve of the door subassembly positioned in the housing opposite the side port and between the spring and the translating sleeve.

6. The sliding side door assembly according to claim 2, wherein the door subassembly further comprises:

a shifting sleeve positioned for movement along the central axis within the housing adjacent the translating sleeve; and an alignment member and an alignment groove cooperatively engaged between the shifting sleeve and the housing such that the shifting sleeve can move along the central axis but is prevented from rotational movement about the central axis; and wherein the helical track is positioned in the translating sleeve and the follower member is positioned on the shifting sleeve;

whereby a first driving movement acting on the door subassembly in a first axial direction along the central axis causes the shifting sleeve to move in the first axial direction, which causes the follower member on the shifting sleeve engaged with the helical track on the translating sleeve to rotate the translating sleeve in a first rotational direction about the central axis, thereby causing the ball port to move into overlapping alignment with the side port to open the side port; and whereby a second driving movement acting on the door subassembly in a second axial direction along the central axis opposite the first axial direction causes the shifting sleeve to move in the second axial direction, which causes the follower member on the shifting sleeve engaged with the helical track on the translating sleeve to rotate the translating sleeve in a second rotational direction about the central axis, thereby causing the ball port to move out of overlapping alignment with the side port to close the side port.

7. The sliding side door assembly according to claim 6, wherein the shifting sleeve is adapted to be engaged by a standard wireline tool for transmitting the first and second driving movements to the shifting sleeve of the door subassembly.

8. The sliding side door assembly according to claim 6, wherein the alignment member is positioned on the shifting sleeve and the alignment groove is positioned on the housing.

9. The sliding side door assembly according to claim 6, wherein the follower member is in the form of a pin and the alignment member is in the form of a pin.

10. The sliding side door assembly according to claim 1, wherein the ball sealing member has a bore formed through the ball sealing member, and wherein a portion of the translating sleeve of the door subassembly is positioned in the bore of the ball sealing member.

11. The sliding side door assembly according to claim 10, further comprising a spring positioned in the housing opposite the side port to urge the ball sealing member toward the side port, thereby assisting in maintaining a sealing engagement between the ball sealing member and the ball seat.

12. The sliding side door assembly according to claim 11, further comprising a seat cushion for the ball sealing member opposite the side port and between the spring and the ball sealing member.

13. The sliding side door assembly according to claim 10, wherein the ball sealing member can be rotated relative to the translating sleeve.

14. The sliding side door assembly according to claim 13, wherein the door subassembly further comprises:

an alignment member and an alignment groove cooperatively engaged between the translating sleeve and the housing such that the translating sleeve can move along the central axis but is prevented from rotational movement about the central axis; and a sleeve port formed in the translating sleeve; and wherein the helical track is positioned in the translating sleeve and the follower member is positioned on the ball sealing member;

whereby a first driving movement acting on the door subassembly in a first axial direction along the central axis causes the translating sleeve to move in the first axial direction, which causes the follower member on the ball sealing member engaged with the helical track on the translating sleeve to rotate the ball sealing member in a first rotational direction about the central axis, thereby causing the sleeve port to move into overlapping alignment with the side port and causing the ball port to move into overlapping alignment with the side port to open the side port; and whereby a second driving movement acting on the door subassembly in a second axial direction opposite the first axial direction along the central axis causes the translating sleeve to move in the second axial direction, which causes the follower member on the ball sealing member engaged with the helical track on the translating sleeve to rotate the ball sealing member in a second rotational direction about the central axis, thereby causing the sleeve port to move out of overlapping alignment with the side port and causing the ball port to move out of overlapping alignment with the side port to close the side port.

15. The sliding side door assembly according to claim 14, wherein the translating sleeve is adapted to be engaged by a standard wireline tool for transmitting the first and second driving movements to the translating sleeve of the door subassembly.

16. The sliding side door assembly according to claim 14, further comprising at least one equalizing port that is substantially smaller than the ball seat formed in the translating sleeve, whereby at least some of any differential pressure across the side port is equalized through the equalizing port before the sleeve port and ball port move into complete overlapping alignment to open the side port.

17. The sliding side door assembly according to claim 14, wherein the alignment member is positioned on the translating sleeve and the alignment groove is positioned in the housing.

18. The sliding side door assembly according to claim 14, wherein the follower member is in the form of a pin and the alignment member is in the form of a pin.

19. The sliding side door assembly according to claim 1, wherein at least a portion of the housing is integrally formed with a tubing section for use in a tubing string.

20. The sliding side door assembly according to claim 1, wherein the ball seat is formed of metal and the ball sealing member is formed of metal create a metal-to-metal seal.

21. The sliding side door assembly according to claim 18, further comprising a metal O-ring for the metal ball seat.

22. A sliding side door assembly for use in a well bore having a side bore, the sliding side door assembly comprising:

(a) a housing having a generally tubular shape and defining a central axis;

(b) a side port formed in the housing;

(c) a ball seat positioned adjacent the side port;

(d) a translating sleeve positioned to rotate within the housing;

(e) a ball sealing member positioned on the translating sleeve, the ball sealing member defining a generally spherical sealing surface portion that is adapted to engage the ball seat;

(e) a ball port formed through the translating sleeve and the ball sealing member;

(f) a helical track formed in the translating sleeve;

(g) a shifting sleeve positioned for movement along the central axis within the housing adjacent the translating sleeve;

(h) an alignment member and an alignment groove cooperatively engaged between the shifting sleeve and the housing such that the shifting sleeve can move along the central axis but is prevented from rotational movement about the central axis; and (i) a follower member on the shifting sleeve cooperatively engaged with the helical track of the translating sleeve;

whereby moving the shifting sleeve in a first axial direction along the central axis causes the translating sleeve to rotate in a first rotational direction about the central axis, thereby causing the ball port to move into overlapping alignment with the side port to open the side port; and whereby moving the shifting sleeve in a second axial direction along the central axis opposite the first axial direction causes the translating sleeve to rotate in a second rotational direction about the central axis opposite the first rotational direction, thereby causing the ball port to move out of overlapping alignment with the side port to close the side port.

23. A sliding side door assembly for use in a well bore having a side bore, the sliding side door assembly comprising:

(a) a generally tubular housing defining a central axis;

(b) a side port formed in the housing;

(c) a ball seat positioned adjacent the side port;

(d) a ball sealing member having a generally spherical shape defining a spherical sealing surface portion that is adapted to engage the ball seat and rotate about the central axis within the housing;

(e) a ball port formed in the ball sealing member;

(f) a bore formed through the ball sealing member;

(g) a translating sleeve positioned within the housing and through the ball sealing member;

(h) a helical track formed in the translating sleeve;

(i) a sleeve port formed in the translating sleeve;

(j) an alignment member and an alignment groove cooperatively engaged between the translating sleeve and the housing such that the translating sleeve can move along the central axis but is prevented from rotational movement about the central axis; and (k) a follower member on the ball sealing member cooperatively engaged with the helical track of the translating sleeve;

whereby moving the translating sleeve in a first axial direction along the central axis causes the translating sleeve to rotate the ball sealing member in a first rotational direction about the central axis, thereby causing the sleeve port, the ball port, and the side port to move into overlapping alignment and opening the side port; and whereby moving the translating sleeve in a second axial direction along the central axis opposite the first axial direction causes the translating sleeve to rotate the ball sealing member in a second rotational direction about the central axis opposite the first rotational direction, thereby causing the sleeve port and the ball port to move out of overlapping alignment with the side port and closing the side port.

24. A sliding side door assembly for use in a well bore comprising:

(a) a generally tubular housing adapted to be placed within the well bore adjacent a side bore of the well bore, the housing defining a central axis;

(b) a side port in the housing to provide fluid communication between the side bore and the interior of the housing;

(c) an alignment groove parallel to the central axis on the interior of the housing;

(d) a spherical ball sealing member defining a generally spherical surface and having a bore therethrough defining a bore axis, the generally spherical surface of the ball sealing member being adapted to close the side port formed in the housing when the bore axis is aligned with the central axis;

(e) a ball port in the sealing ball, whereby the sealing ball can be rotated about the bore axis into overlapping alignment with the side port formed in the housing to open the side port;

(f) a follower member on the ball sealing member;

(g) a translating sleeve positioned in the housing adjacent the side port formed in the housing and through the bore of the spherical sealing ball;

(h) a sleeve port formed in the translating sleeve whereby when the translating sleeve is moved axially along the housing axis, the sleeve port can be moved into or out of overlapping alignment with the side port of the housing;

(i) an alignment member on the translating sleeve, whereby the translating sleeve can be shifted axially along the central axis while preventing the translating sleeve from rotating about the central axis; and (j) a helically spiraled track formed on the exterior of the translating sleeve, whereby the follower member on the ball sealing member causes the ball sealing member to rotate about the central axis as the translating sleeve is shifted along the central axis.

* * * * *